United States Patent [19]

Baso

[11] 4,190,969

[45] Mar. 4, 1980

[54] TENSION ELEMENT FOR A SKI BOOT FASTENER

[76] Inventor: Loris Baso, Corso Milano Nr. 43, Padova, Italy

[21] Appl. No.: 911,835

[22] Filed: Jun. 2, 1978

[30] Foreign Application Priority Data

Jun. 3, 1977 [IT] Italy ..... 41616 A/77
Jul. 5, 1977 [IT] Italy ..... 41635 A/77

[51] Int. Cl.[2] ..... A43B 11/00; A43C 11/00

[52] U.S. Cl. ..... 36/50; 24/69 SK; 24/70 SK

[58] Field of Search ..... 36/50, 117, 118, 119, 36/120, 121; 24/68 SK, 69 SK, 70 SK, 71 SK, 81 SK

[56] References Cited

U.S. PATENT DOCUMENTS 3,902,226 9/1975 Messenbaugh ..... 24/69 SK
4,051,611 10/1977 Chalmers ..... 24/68 SK
4,096,648 6/1978 Guolo ..... 36/50

FOREIGN PATENT DOCUMENTS 1443559 5/1966 France ..... 36/50

*Primary Examiner*—Patrick D. Lawson
*Attorney, Agent, or Firm*—Blanchard, Flynn, Thiel, Boutell & Tanis

[57] ABSTRACT

A tension element for a ski boot fastener having a wire, i.e. cable, formed into a U-shape. The ends of the cable are received in a tube also bent into a U-shape. The ends of the tube are compressed onto the cable to effect a securement therebetween. The tube defines a clasp receivable in the hooks provided on a tension lever. The loop so formed is at least partly encased in plastic, the plastic material forming a web between the cable pieces forming the sides of the loop.

9 Claims, 9 Drawing Figures

4
3
5

2
1a
IV
IV
1
12
7
1c
1b
6.
6a
8
2
12
6.

9.
8
2
12
4
11
2
4
10

7a
1c 14
15
17
16
VI
VI
1
1c
1c
18
IV
IV
7
6.
6a
13
13a 16
7
1

14
15
18

19
7
1c
20
20a
21

22
23
7
1
24
25

TENSION ELEMENT FOR A SKI BOOT FASTENER

FIELD OF THE INVENTION

The invention relates to a tension element for a ski boot fastener, comprising a wire, i.e. cable, which is formed into a loop and is surrounded at least partly with a flexible plastic and the ends of which are connected with one another by a tube-shaped compressed-lock element and at one end of the loop there is provided a substantially U-shaped clasp of a rigid material for hanging on a tensioning lever which is mounted on the ski boot and a connecting means for connecting the loop to the ski boot engages the second end of the loop.

BACKGROUND OF THE INVENTION

Such known locking elements consist mostly only of a cable made of steel, which is bent to form a loop. The ends of the cable are held together by a tube-shaped compressed-lock element. For this purpose, the ends of the cable are inserted into the compressed-lock element, same is then pressed together and mostly in addition bent. By bending the compressed-lock element into a U-shape, the compressed-lock element forms simultaneously a U-shaped clasp, which can be hung on the tensioning lever of the ski boot. Many times in conventional tension elements the cable is additionally surrounded by a tube of plastic.

These conventional tension elements, however, do not lend the ski boot which is made of plastic a pleasant appearance and furthermore increase the price of its manufacture. Namely channels and guideways are needed on the ski boot, in order for the loops to be held in the correct position on the ski boot. The channels and guideways which are necessary on the ski boot itself increase the price of manufacture of the ski boot because three to five tension elements must be mounted on every pair of ski boots and the channels and guideways must therefore be worked into the injection mold which is used for the manufacture of the ski boot. It must hereby be considered that at least two injection molds are needed for each boot size.

The basic purpose of the invention is to produce a tension element for a ski boot fastener of the above-mentioned type, which maintains the flexible characteristics of the up to now used tension element, however, does not need any guideways and channels on the ski boot so that the injection mold for the manufacture of the ski boot is simplified and furthermore the appearance of the ski boot is improved.

This purpose is attained according to the invention by the cable loop being arranged substantially inside of a plastic band which extends to the clasp such that the cable pieces which are provided between the ends extend substantially parallel and spaced from one another and by the space which lies between the cable pieces being filled with plastic, which also surrounds the cable pieces and forms a web between same.

The plastic band gives the tension element a certain rigidity in the plane of the tension element. In spite of this, however, the tension element remains still sufficiently flexible transversely to the plane so that it adapts to the form of the ski boot. Due to the stiffness of the tension element, or flexible strap, in transverse direction, channels or guideways do not need to be provided on the ski boot. As a result, the injection mold is simplified and the manufacture of the ski boot becomes less expensive. Furthermore the ski boot has a better appearance, especially since the cable loop is enclosed totally or almost totally by the plastic of the band. The cable is also protected against any damage by the plastic. Furthermore high tension forces can be transmitted with the new tension element, without fearing any damage.

The plastic band has preferably at its second end a hole to receive a rivet therethrough which serves as a joint and the cable loop is arranged near the hole in the band and surrounds approximately half of the hole. Through this design of the tension element, the problem of fastening of the tension element in the area of the ankle of the ski boot is solved. Up to now it has namely always been problematic to provide in the ankle area a fastening for a tension element. The rivet joint serves now at the same time for fastening the tension element and for the hingelike connection of the upper part of the ski boot to the lower part of the ski boot. Since the cable loop is arranged near the edge of the hole, the tension forces are transmitted directly from the cable loop onto the rivet joint.

BRIEF DESCRIPTION OF THE DRAWINGS

Further details and advantages of the invention are discussed more in detail hereinafter with reference to several exemplary embodiments which are illustrated in the drawings, in which.

DETAILED DESCRIPTION

Figures 1, 2, 3:
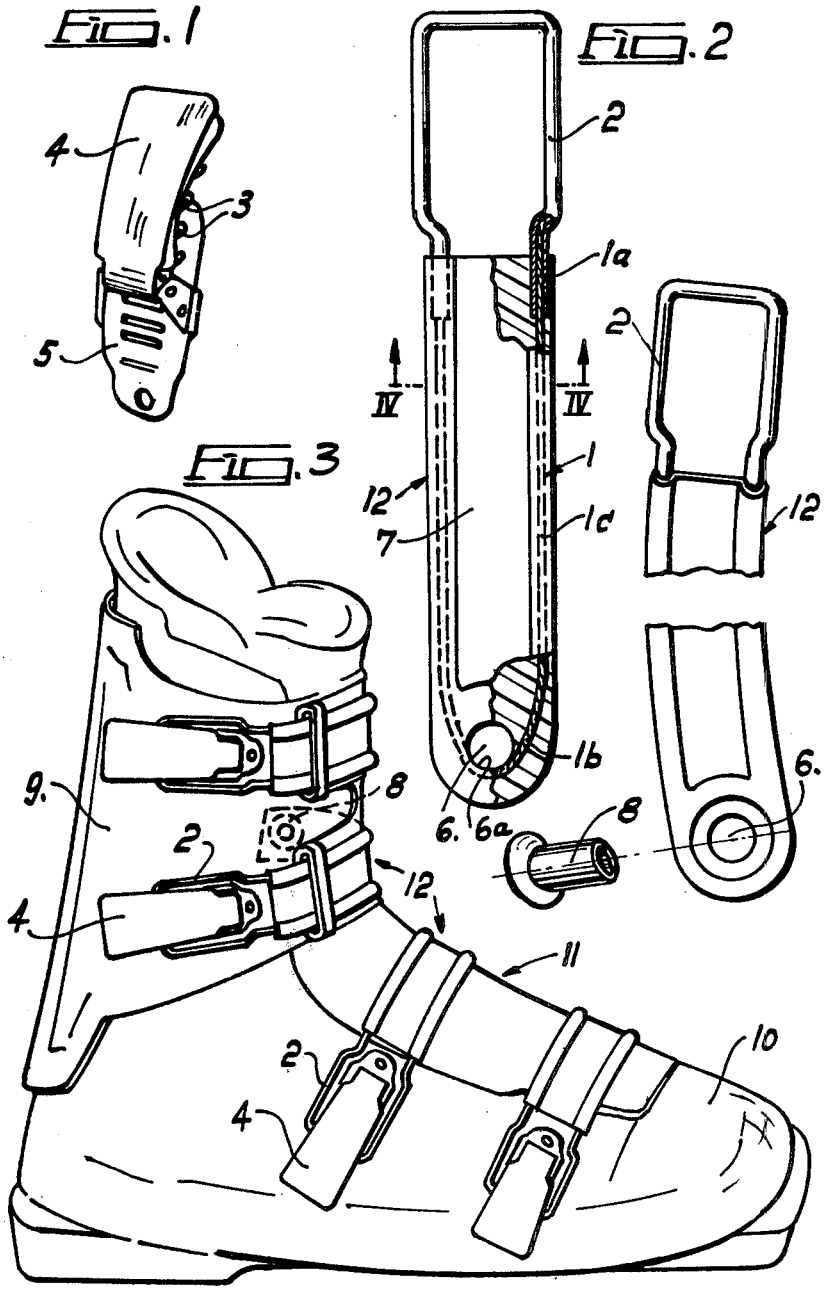
FIG. 1 is a diagrammatic illustration of a first exemplary embodiment of the inventive tension element.
FIG. 2 is a partially sectional top view of the tension element.
FIG. 3 illustrates a ski boot with several tension elements.

The cable which consists of steel is bent to form a loop. The ends 1*a* of this cable are placed into a tube 2, which consists also of steel. This tube is strongly compressed after the ends 1*a* have been placed into the tube, so that the ends 1*a* can no longer be removed from the tube 2. The tube 2 forms thus a compressed-lock element. The tube 2 is furthermore bent into a U-shape and serves therefore also as a clasp for hanging into various hooks 3 of a tensioning lever 4, the bearing plate 5 of which is secured on a ski boot.

The cable loop 1 is encased substantially inside of a plastic band 7 which consists of a thermoplastic, flexible plastic and only the tube 2 which is provided at the one end of the plastic band projects from the plastic. The second end 1*b* of the cable loop 1 is arranged near an edge 6*a* of a hole 6 which is provided in the plastic band. The end 1*b* of the loop 1 surrounds approximately half of the hole 6. The hole 6 serves for a passage of a larger rivet 8, which is used for the hingelike connection of the upper part 9 of the ski boot 11 to the lower part 10. At the same time, however, the rivet joint 8 serves to connect the resulting tension element, or flexible strap, 12 to the ski boot. Since the cable 1 is arranged at the edge 6a of the hole 6, the tension forces are transmitted directly from the part 1b of the wire 1 onto the rivet joint 8 and from same onto the ski boot. The two cable pieces 1c which extend between the one end which is formed by the tube 2 and the other end 1b of the cable loop 1 extend substantially parallel to one another and are laterally spaced from one another. The lateral spacing between the cable pieces 1c is also filled in with plastic, which also surrounds the cable pieces 1c and forms a web 7a therebetween. The plastic band 7 lends the cable loop 1 a certain rigidity in its plane and the entire tension element has still transversely to the plane of the cable loop the desired flexibility.

Figures 4, 5, 6, 7, 8, 9:
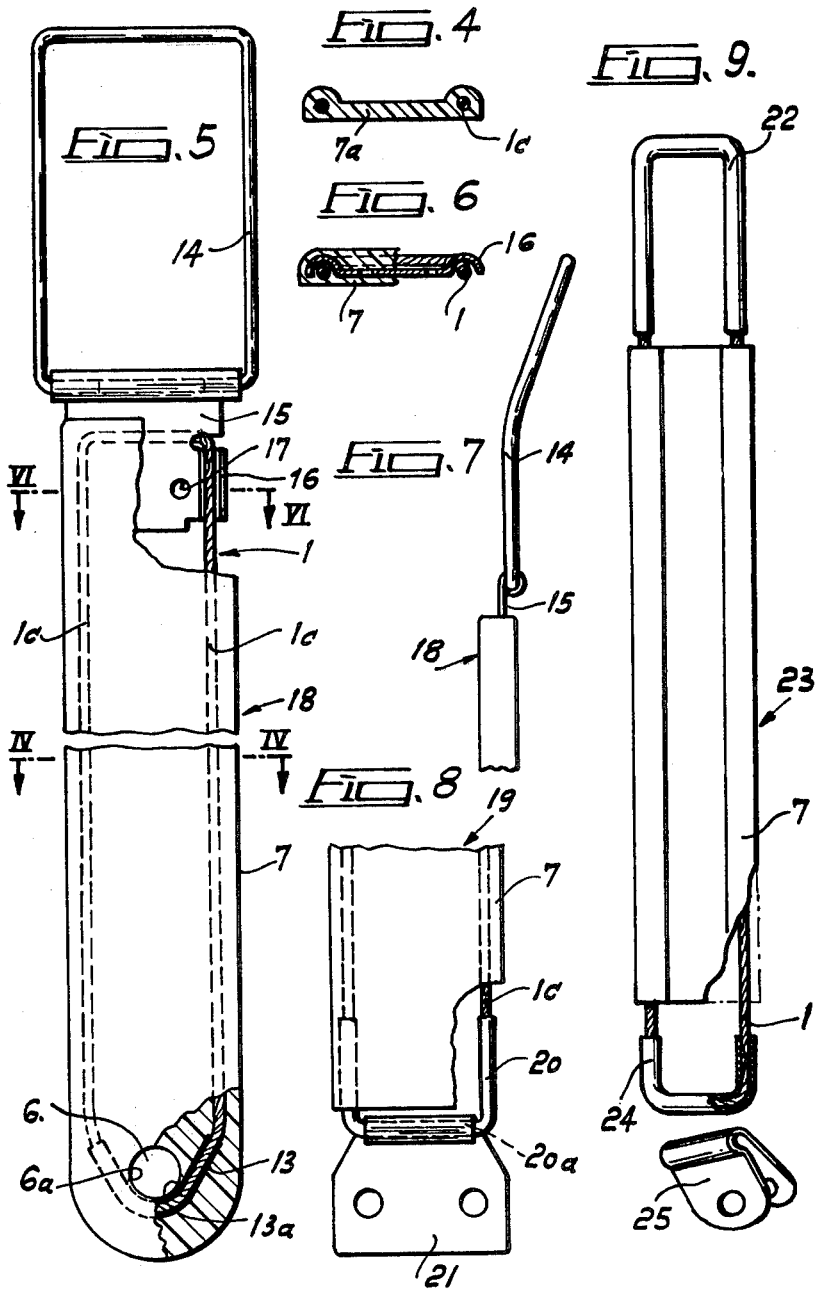
FIG. 4 is a cross-sectional view along the line IV—IV of FIG. 2 or 5.
FIG. 5 is the bottom view of a second exemplary embodiment.
FIG. 6 is a cross-sectional view along the line VI—VI of FIG. 5.
FIG. 7 is a partial side view of this exemplary embodiment.
FIG. 8 is a partial top view of a third exemplary embodiment.
FIG. 9 is a top view of a fourth exemplary embodiment.

In the exemplary embodiment which is illustrated in FIGS. 5 to 7, the compressed-lock element 13 which consists also of a steel tube is bent substantially V-shaped and it surrounds with its part 13a the edge 6a of a hole 6. The cable loop 1, like in the first exemplary embodiment, is embedded in the plastic band 7 and the cable pieces 1c are arranged parallel to one another and are laterally spaced from one another. The cross section of this exemplary embodiment corresponds with the cross section illustrated in FIG. 4. To connect the wire loop 1 to the clasp 14, which like in the first exemplary embodiment can be hung into a tension lever 4, a holding plate 15 is used, on which the clasp 14 is pivotally supported. The holding plate 15 has means 16 for hanging up the one end of the loop 1. The hanging means 16 and the larger portion of the holding plate 15 are encased by the plastic of the band 7. The hanging means 16 are each formed by a flap which is punched out on each longitudinal side of the holding plate and bent semicircularly with respect to the plane of the holding plate. This flap forms a channel and opens toward one side of the plate. Each one of the flaps, however, extends only over approximately half of the longitudinal side of the holding plate 15. The cable loop 1 is placed into the channels of the flaps 16 and extends then over the upper side of the plate 15. The holding plate 15 furthermore has holes 17, which are also filled with plastic so that the plastic parts are connected on both sides of the holding plate. The tension element 18 which is illustrated in FIGS. 5–7 is also secured to the ski boot with a rivet joint which is also not illustrated.

The tension element 19 which is illustrated in FIG. 8 is designed on the one side just like the tension element 18. It has there also a holding plate 15 and a clasp 14. These parts are, however, not illustrated in the drawings. The other end of the tension element 19, which is fixedly connected to the ski boot, is illustrated in FIG. 8. The compressed-lock element 20 with which the ends of the cable loop 1 are connected, is hereby bent into a U-shape. Only a small part of this compressed-lock element 20 projects from the plastic band 7. A fastening flap 21 is hinged to the projecting U-bar 20a of the compressed-lock element 20. The fastening flap 21 is secured by means of two not illustrated rivets on the ski boot.

A further exemplary embodiment is illustrated in FIG. 9. The cable loop 1 is encased by the plastic band 7 hereby in a similar manner as in the preceding exemplary embodiment. A U-shaped clasp 22 is hinged to the one end of the cable loop 1, which clasp can serve to hang in the tensioning lever. The U-shaped clasp 22 can be formed by a tube which is pulled over the cable. The compressed-lock element 24 is arranged at the other end of the tension element 23, which compressed-lock element is also bent into a U-shape. A fastening plate 25 is hinged to the compressed-lock element 25, which fastening plate is used to fasten the tension element 23 to the ski boot. Of course, the arrangement can also be such, that the compressed-lock element, similar to the exemplary embodiment illustrated in FIGS. 1 and 2, is arranged on the end of the tension element 23, which also engages the tensioning lever. In this case, a U-shaped bent tube is then provided at the other end and the fastening plate 25 is engaged therewith.

The embodiments of the invention in which an exclusive property or privilege is claimed are defined as follows:

1. In a tension element for a ski boot fastener, comprising a cable which is formed into a loop and is surrounded at least partially with a flexible plastic, the ends of which cable are connected through a tube-shaped compressed-lock element and at one end of the loop there is provided a substantially U-shaped clasp of a rigid material for hanging on a tensioning lever which is mounted on the ski boot and a connecting means for connecting the loop to the ski boot engages on the second end of the loop, the improvement comprising the cable loop being arranged substantially inside of a plastic band which extends to the clasp such that the cable pieces which are provided between the ends extend substantially parallel and spaced from one another, the space which lies between the cable pieces being filled out with plastic, which also surrounds the cable pieces and forms a web between the same, the plastic band having a hole at the second end for passage of a rivet which serves as a joint, the cable loop being arranged near the edge of said hole and surrounding approximately half of the hole.

2. The improved tension element according to claim 1, wherein the compressed-lock element is bent substantially into a U-shape and also surrounds the hole edge.

3. The improved tension element according to claim 2, wherein the clasp is hinged to a holding plate, which has means for hanging the one end of the loop, and wherein said hanging means and the greater part of the holding plate are surrounded by the plastic of the band.

4. The improved tension element according to claim 3, wherein the hanging means each consist of a flap which is punched out of every longitudinal side of the holding plates and is bent semicircularly with respect to the plane of the holding plate, which flap is open toward one side of the plate and each flap extends only over a part of the longitudinal side of the holding plate.

5. In a ski boot fastener, a flexible strap comprising:

a cable formed into a loop, a substantially U-shaped clasp of a rigid material at one end of the loop for hanging on a tensioning lever mounted on the ski boot, and a connecting means on the second end of the loop for connecting the loop to the ski boot, the ends of which cable being connected through a tube-shaped compressed-lock element, wherein the improvement comprises a flexible plastic band encapsulating the cable loop between the cable loop ends and extending to the clasp, the cable pieces between the cable loop ends extending substantially parallel to and being spaced from one another, the space between the cable pieces being filled with the flexible plastic of said band, which both surrounds the cable pieces and forms a flexible web therebetween.

6. The fastener according to claim 5, wherein said clasp is formed at the first end of the cable loop by said compressed-lock element bent into a U-shape.

7. The fastener according to claim 5, wherein the compressed-lock element is bent into a U-shape, is arranged on the second end of the loop and projects at least partially from the plastic band and including a fastening plate hinged to the bight of said U-shaped compressed-lock element.

8. A ski boot fastener, comprising:

a tensioning lever mounted on the ski boot;

a flexible strap including a cable formed into a loop, a substantially U-shaped clasp of a rigid material at one end of the loop for hanging on said tensioning lever, and a connecting means on the second end of the loop for connecting the loop to the ski boot, the ends of said cable being connected through a tube-shaped compressed-lock element, said flexible strap further including a flexible plastic band encapsulating the cable loop between its ends and extending to said clasp, the cable pieces between said cable loop ends extending substantially parallel to and being spaced from one another, the space between the cable pieces being filled with the flexible plastic of said band, which both surrounds the cable pieces and forms a flexible web therebetween, said web fixedly maintaining said spacing of said cable pieces along the surface of said web, said cable pieces and web being freely bendable together in directions transverse to the surface of said web to bend said strap around the ski boot.

9. The fastener according to claim 8 in which the plastic band extends to said second end of said loop to encapsulate the latter with said cable pieces, and means defining a hole through said web immediately inboard of said second loop end, said connecting means including a member securable through said hole to said ski boot.

* * * * *